US005101896A

United States Patent [19]

Thompson et al.

[11] Patent Number: 5,101,896

[45] Date of Patent: * Apr. 7, 1992

[54] PIPE WIPER AND WASHER SYSTEM

[76] Inventors: J. P. Thompson, Rt. 1 Box 792A, Moselle, Miss. 39459; Henry Guillory, deceased, late of Abbeville, La.; by Margaret S. Guillory, executor, 205 Alcide Dr., Abbeville, La. 70501; by Carroll L. Guillory, heir, 205 Alcide Dr., Abbeville, La. 70501; by Laura P. Broussard, heir, 205 Alcide Dr., Abbeville, La. 70501; Alfred J. Thomas, II, 136 Teche Dr., Lafayette, La. 70503

[ * ] Notice: The portion of the term of this patent subsequent to Jan. 23, 2007 has been disclaimed.

[21] Appl. No.: 361,251

[22] Filed: Jun. 5, 1989

Related U.S. Application Data

[63] Continuation-in-part of Ser. No. 110,371, Oct. 19, 1987, Pat. No. 4,895,205.

[51] Int. Cl.[5] ..... E21B 19/00

[52] U.S. Cl. ..... 166/90; 166/82; 166/92; 166/311; 175/84

[58] Field of Search ..... 166/81, 82, 83, 88, 166/90, 92, 93, 118, 310, 311; 175/84

[56] References Cited

U.S. PATENT DOCUMENTS

| | | | |
|---|---|---|---|
| 4,004,326 | 1/1977 | Beavers | 175/325 X |
| 4,042,023 | 8/1977 | Fox | 166/241 |
| 4,198,789 | 4/1980 | Wheeler | 175/84 X |
| 4,279,300 | 7/1981 | Wirsch | 166/90 |
| 4,494,607 | 1/1985 | Ford et al. | 166/311 |
| 4,619,321 | 10/1986 | Molina | 166/90 |

FOREIGN PATENT DOCUMENTS

| | | | |
|---|---|---|---|
| 0578442 | 10/1977 | U.S.S.R. | 166/82 |

*Primary Examiner*—William P. Neuder
*Attorney, Agent, or Firm*—Pravel, Gambrell, Hewitt, Kimball & Krieger

[57] ABSTRACT

What is provided is a system for washing and cleaning sections of drill pipe being tripped out of the hole, and the system including a cylindrical housing having a central opening therethrough, the cover sections movable between open and closed positions by hinged joint along one edge, utilizing a system of hydraulic system cylinders, and in the closed position, maintain closed for defining a chamber therewithin. Within the housing chamber there is further included a wiper member, which comprises a circular member of rubberized material having a bore through its central axis through which sections of pipe travel during the cleaning process, the bore being a width so as to frictionally engage and wipe the wall of a section of drill pipe. The wiper would be spaced apart from the housing and housed within an annular channel along the inner surface of the housing so that the wiper would be stationary within the housing as the housing is placed in the closed position.

10 Claims, 4 Drawing Sheets

PIPE WIPER AND WASHER SYSTEM

This is a continuation-in-part of application entitled "Pipe Washer And Chemical Applicator System", bearing U.S. Ser. No. 07/110,371, Filed Oct. 19, 1987, now U.S. Pat. No. 4,895,205.

BACKGROUND OF THE INVENTION

1. Field of the Invention

The present invention relates to cleaning of drill pipe. More particularly, the present invention relates to a system for wiping or washing a drill pipe as it is tripped out of the hole.

2. General Background

In the drilling of oil wells, the drill string is comprised of a plurality of sections of drill pipe threaded together end to end to make up the continuous string. From time to time, for various reasons, for example, to change the bit at the end of the string, the string must be raised or "tripped"out of the hole in order to have access to the drill bit. When the pipe is brought out of the hole, the various sections are removed from the string in view of the fact that often times the string may be thousands of feet long. During the process of drilling, it is necessary that the cuttings formed from the drill bit be removed from the hole, and that the well head be maintained under a certain hydrostatic pressure. Therefore, drilling mud is circulated down through a bore in the drill pipe, and is recirculated up the hole in the annular space between the drill pipe and the hole drilled by the bit. As the string is removed from the hole, the string will carry with it mud that is surrounding it as the drilling is going forth, therefore the result is that the mud, whether it be water based or oil based is lodged onto the surface of the drill pipe, as the pipe is brought up.

In the present state of the art, the roughneck on the rig washes down the pipe with a hose or the like in order to attempt to wash the mud from the pipe surface so that mud is not carried up as the sections of the pipe are broken apart. This however, leads to (a) a loss in the valuable drilling mud that is utilized in the drilling process, and (b) casting off of mud on the rig floor or in the area of the blow-out preventers, which is not in keeping with the proper maintenance of the rig.

At the present time, applicant's have U.S. application Ser. No. 07/110,371 entitled "Pipe Washer And Chemical Applicator System" addresses the wiping, washing, retreating drill string pipe as it is tripped out of the hole. Although this is a necessary operation in many instances, the practical construction of the apparatus presents certain problems. One problem confronted is the fact that the apparatus must be manually opened and closed in order to replace any of the wipers that are positioned within the apparatus, and due to the nature of the complexity of the apparatus, the apparatus calls for multiple wipers which are not always needed in most instances.

The following patents were obtained as a result of a search conducted, and were cited in the parent case, all of which may be relevant to the art of cleaning drill pipe.

| PATENT NO. | INVENTOR | TITLE |
|---|---|---|
| 4,503,577 | Fowler | "Pipe And Hose Decontamination Apparatus" |
| 4,600,444 | Miner | "Pipe End Area Cleaning System" |

-continued

| PATENT NO. | INVENTOR | TITLE |
|---|---|---|
| 2,960,706 | Dunham | "Pile Cleaning And Treatment Device" |
| 4,157,096 | Miller, Jr. | "Apparatus For Cleaning Threaded Pipe Ends" |
| 4,011,617 | Toelke, et al | "Cleaner For Tubular Pin And Box Ends" |
| 3,971,442 | Scott | "Method Of Cleaning Tubular Members On A Rig Floor" |
| 4,457,366 | Brown | "Wiper Device For Stripping Fluid From Well Pipe" |
| 4,406,331 | Bentley | "Pipe Wiper" |
| 4,004,326 | Beavers | "Cable Protector" |
| 4,042,023 | Fox | "Control Line Protector" |
| 4,494,607 | Ford et al. | "Method of Cleaning and Inhibiting Sucker Rod Corrosion" |
| 4,198,789 | Wheeler | "Sleeve Assembly" |
| 4,279,300 | Wirsch | "Treating Fluid Applicator" |
| 4,619,321 | Molina | "Method and Apparatus For Treating Down Hole Equipment From Corrosion In Production Well" |
| 0,578,442 | Soviet Union | Oil Safety Tech |

SUMMARY OF THE PRESENT INVENTION

The system of the present invention solves the shortcomings in the art in a simple and straightforward manner. What is provided is a system for washing or wiping sections of drill pipe being tripped out of the hole, the system including a circular housing having a central opening therethrough, the housing covered by semi-circular cover sections each section movable between open and closed positions hinged along one common edge, by utilizing a system of hydraulic cylinders, and in the closed position, maintained closed for defining a chamber therewithin. Within the housing chamber there is further included a wiper member, which comprises a circular member of rubberized material having a bore through its central axis through which sections of pipe travel during the cleaning process, the bore being of a width so as to frictionally engage and wipe the wall of a section of drill pipe. The wiper would be spaced apart from the housing and housed within an annular channel along the inner surface of the housing so that the wiper would be almost stationary within the housing as the housing is placed in the closed position.

Further there is included spacers along the floor of the housing, supporting the wiper above the floor so that any fluid or the like which would flow off of the wiper would flow between the wiper and the floor. The housing would be open to ports in the inner wall of the housing for allowing fluid flow from the housing to flow into the bell nipple, during use of the system. Further, while drilling in the neighborhood of 2,500 to 10,000 feet in depth, there may be included water flowlines providing water pumped under pressure to various nozzles below the wiper for pumping water under pressure into a system, so that to assist in the cleaning of the pipe moving therethrough.

Therefore, it is the principal object of the present invention to provide a pipe wiper system mountable on the upper end of the bell nipple for wiping and cleaning the drill string as the string is tripped out of the hole;

It is a further principal object of the present invention to provide a system which incorporates a housing around a drill string for cleaning the drill string, the housing covered by a pair of semi-circular cover sections which are hydraulically moved between open and closed positions for easy removal and replacement of the cleaning rubber therewithin;

It is still a further object of the present invention to provide a pipe wiper system that can be mounted on the bell nipple, and including a cover portion which can be hydraulically opened and closed from the floor of the drill rig, so that a wiper positioned within the system can be easily removed and replaced, and the cleaning of the pipe can be undertaken without interruption of the system. This operation does not require personnel at the cite of the invention.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
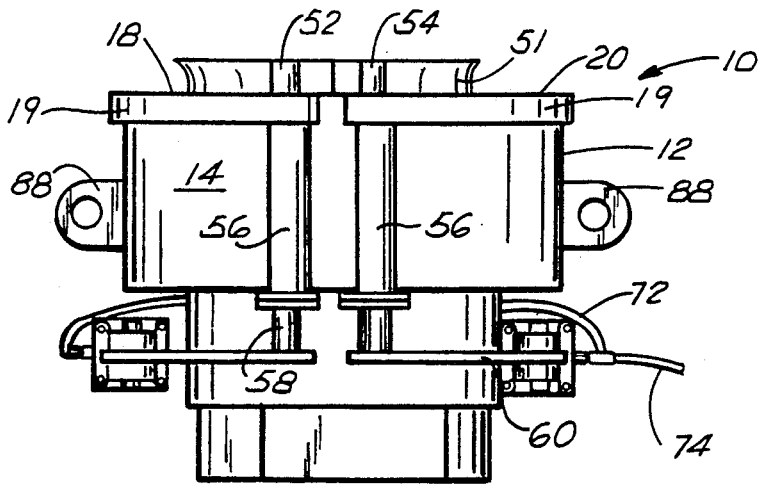
FIG. 1 is an overall side view of the preferred embodiment of the apparatus of the present invention.

The system of the present invention is illustrated in the Figures by the numeral 10. As illustrated in the Figures, system 10 would comprise an annular housing 12 having a continuous circular sidewall 14, the circular wall portion 14 of housing 12 defining a housing space 16 therewithin. Housing 12 would further comprise first and second semi-circular cover portions 18, 20, the semi-circular cover portions 18, 20 movable between open and closed positions, via an operational means 22 (FIG. 7) as will be described further. Cover portions 18, 20 further include a semi-circular overlapping lip portion 19 which would engage the outer surface of housing sidewall 14 when in the closed position as seen in FIG. 1.

Figure 2:
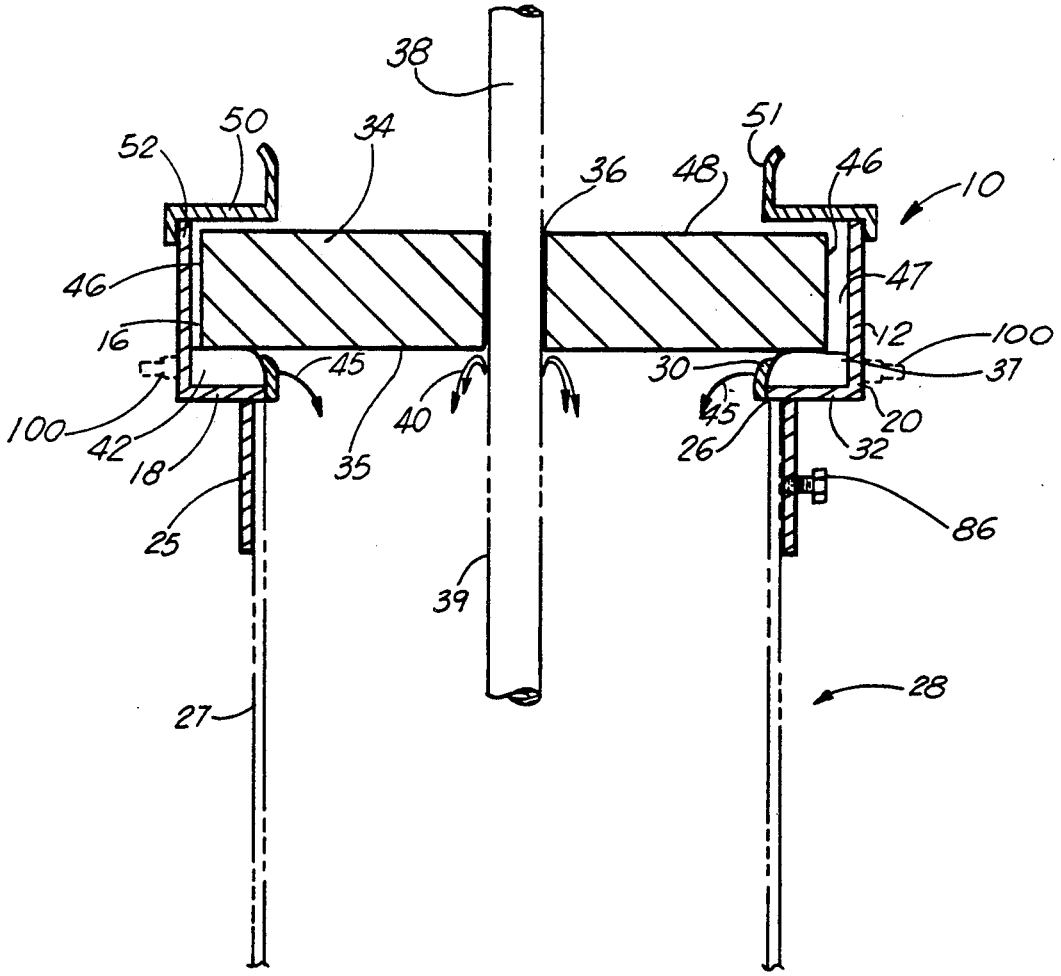
FIG. 2 is a cross-section elevational view of the preferred embodiment of the apparatus of the present invention.
Figure 3:
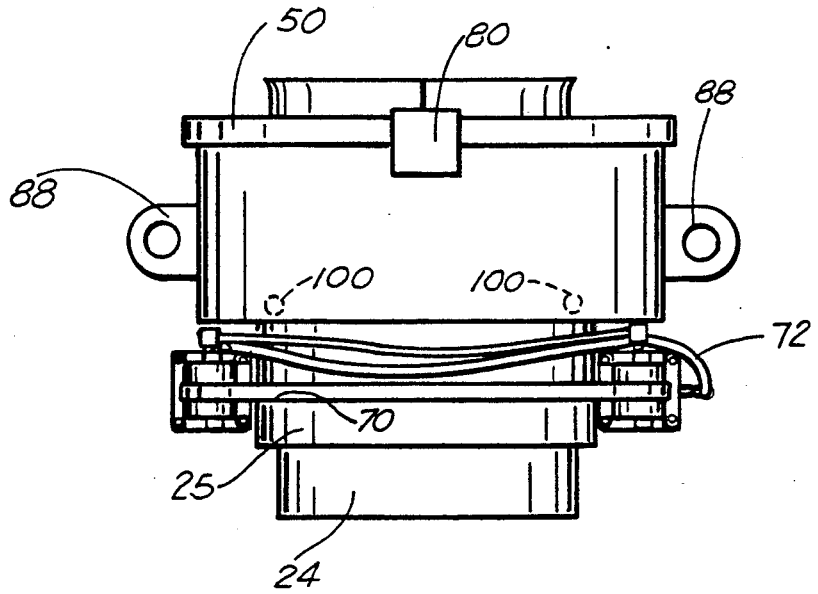
FIGS. 3 and 4 are front and side views respectively of the preferred embodiment of the apparatus of the present invention.

As illustrated in FIG. 2, the system 10 is illustrated as housing 12, which in reality would be in the preferred embodiment and a section of external casing having a wall thickness of approximately one-half inch which would define the housing space 16 therewithin. As illustrated, housing 12 is positioned atop the end portion of a bell nipple 28, with housing 12 including the circular wall sidewall 14, including a floor portion 32, which in reality would be a plate welded to the bottom end of wall portion 14, and extending inwardly to overlap the ends of bell nipple 28. There would be further included an annular wall member 25 secured to the lower face of floor portion 32, the diameter of annular portion 25 such that it would slidingly engage over the end of bell nipple 28 as indicated in FIG. 2, so that floor portion 32 supporting housing 12 would rest upon the bell nipple as illustrated. The inner surface of floor portion 32 would include an outwardly curling lip member 30, rising above the floor portion 32, of housing 12. Lip member 30 would include a plurality of ports 31 along floor 32 to drain off fluids, and return fluids to the bell nipple 28. Further, there would be included a plurality of spacer members 42 positioned along the internal surface of the floor portion, for allowing the wiper member 34 to rest upon the spacer members, and not make contact with the floor portion 32. For purposes of construction, spacer members 42 would support wiper member 34 above the height of lip member 30, for allowing the drainage of fluids therethrough. For purposes of construction spacer members 42 would support wiper member 34 above the height of lip member 30, for allowing the drainage of fluids therethrough.

As illustrated, the diameter of bore 36 would be slightly less than the diameter of the drill string 38, but due to its flexibility would frictionally engage and allow the drill string 38 to move upward through the bore 36 as the drill string was being tripped out of the hole. In doing so, any mud or the like contained on the wall 39 of drill string 38 would be wiped off by the engagement of wiper 34 against the wall 39, and would be forced back into the lower portion of the bell nipple 28 in the direction of arrows 40. As is illustrated wiper 34 rests within chamber 16, supported on a plurality of raised spacer members 42, equally spaced along the floor 32 of chamber 12, so as to provide a flow space 37 between the lower surface 35 of wiper 34 and floor 32 of chamber 12. Therefore, any excess fluid flowing off of the lower surface 35 of wiper 34 would flow in flow space 37 in the direction of arrows 45 as illustrated. As is further illustrated wiper 34 is of a circumference so that the outermost wall 46 of wiper 34 is of a lesser diameter than the diameter of the chamber 16, and therefore there is further provided an annular flow space 47 between the wall of chamber 12 and the outer wall 46 of wiper 34 likewise for allowing any fluid flowing off of the upper surface 48 of wiper 34 would flow through annular space 47 and into the bell nipple in the direction of arrows 45.

As seen in the preferred embodiment, in this simplified version a single wiper 34 is positionable within chamber 16, and would be held in place via an annular cover 50, which comprises semi-circular cover portions 18, 20, so that wiper 34 would be maintained within chamber 12 while the top cover portions 18, 20 to form cover 50 are in the closed position.

Figure 4:
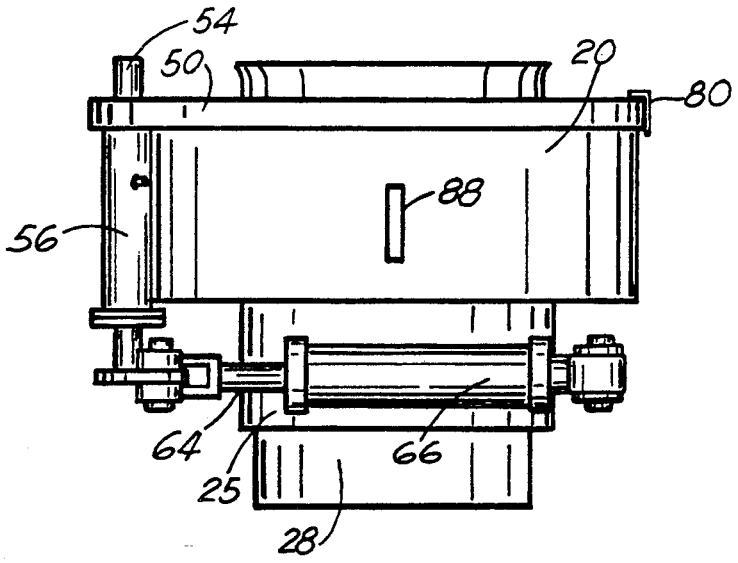
Figure 7:
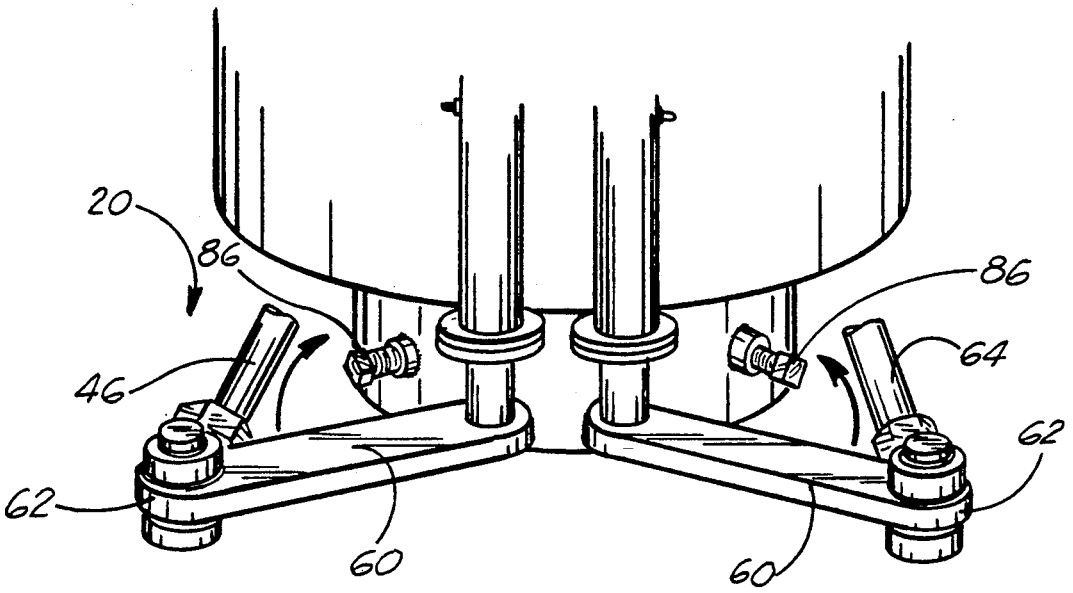
FIG. 7 is a partial view of the hydraulic system in the opening and closing of the apparatus of the present invention.

Further, as illustrated apparatus 10 includes an outer mounting sleeve 25, for defining the annular space therebetween for housing the upper end 26 of bell nipple 28 while supporting apparatus 10 thereupon. As illustrated sleeve 25 may include several bolts 86 for engaging the bell nipple wall 27 when securely mounted:

Turning now to the operational features of the system, and the manner in which the semi-circular cover portions 18, 20 are moved between open and closed positions, reference is made to FIGS. 1 and 7 where there is illustrated a pair of vertical pin members 52, 54, each of the pin members extending through a collar 56 to each of the cover portions 18 and 20. Collars 56 would define a means for retaining the pins 52, 54 vertically on housing 12, and secure each of the semi-circular cover portions 18, 20 onto the pin members 52, 54 during operation. Each of the pin members would be mounted on their lower ends 58 to a pair of horizontal arm members 60. As seen in FIG. 7 each arm member 60, on its distal most end 62, is rotatably mounted to the ends of hydraulic pistons 64. Each in turn which would be movable within hydraulic cylinders 66, (FIG. 4) with farthest end 68 of each hydraulic cylinder 66 mounted onto a fixed bar member 70 which has been welded to circular base 25. Of course each of the hydraulic cylinders would be fed with the necessary hydraulic feed lines 72, and be further included a line 74 which could lead to the rig floor or the like and the hydraulic cylinders could be operated from the rig floor away from the apparatus itself in order to afford easy and efficient operation.

Figure 5:
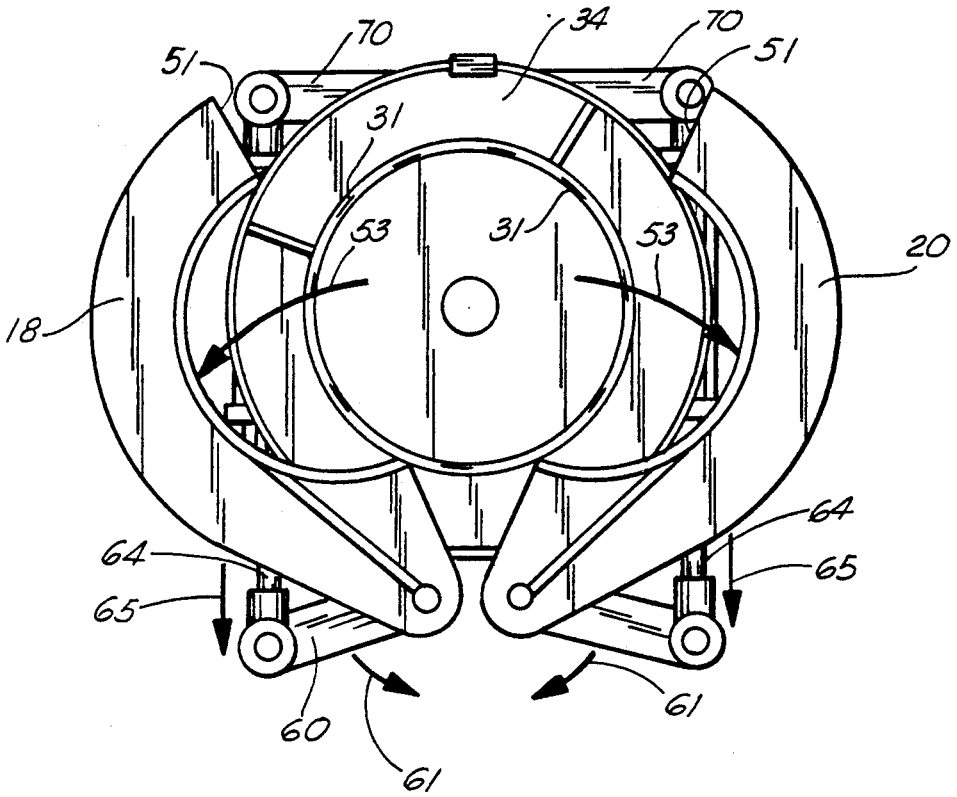
FIGS. 5 and 6 are top views showing the apparatus in the open and closed positions respectively in the preferred embodiment of the present invention.
Figure 6:
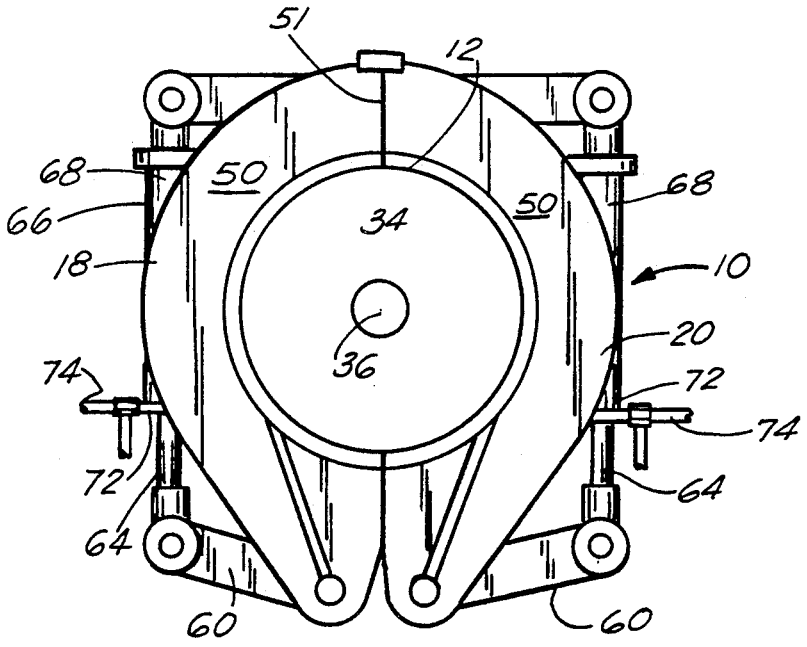

As seen in FIGS. 5 and 6 in operation, FIG. 6 illustrates apparatus 10 in the closed position, with semicircular cover portions 18, 20 secured to form housing space 16 housing the wiper 34. As illustrated wiper 34 would have a central bore 36 through which a section of pipe 38 passes therethrough. As illustrated each of the semi-circular half cover portions 18, 20 would define the upper top portion 50 in the closed position for maintaining wiper 34 in place. Cover portion 50 includes an upper extending lip portion 51 which serves as a guide so that the bit and other tools would not make contact with the upper surface of cover portion 50 when the unit is in the closed position. As illustrated, the pair of hydraulic cylinders 66 are in the closed position, with pistons 64 having been retracted within cylinder 66, and in doing so arms 60 have been pulled inwardly which would likewise pull the semi-circular cover portions 18, 20 into the close position as seen in FIG. 6. The position as seen in FIG. 6 would be the operable position wherein the drill pipe would be pulled through the wiper during the cleaning process.

Turning now to FIG. 5, as illustrated, the pistons 64 have been moved outwardly in the direction of arrows 65 as illustrated, importing rotation to arm members 60, in the direction of arrow 61, and in doing so the farthest most ends 51 of each of the half portions 32, 20 which define closed cover portion 50 have moved outwardly away from wiper 34 as illustrated by arrows 53 in FIG. 5, therefore having easy access to wiper 34 and removal from chamber 16. After wiper 34 has been replaced, for example within chamber 16, the pistons are then moved to the closed position wherein each of the semi-circular cover portions 18, 20 would return to the closed position for defining closed cover 50 as illustrated in FIG. 6 thus once again containing wiper 34 within chamber 16 for operation.

In this method of operation, it is therefore clear that the removal of wiper 34 from chamber 16 with the use of hydraulic cylinders effects an efficient and quick manner of removal, which does not require the presence of an operator at the sight of the apparatus during removal.

Turning now to some of the particulars of the operation of the apparatus, it should be noted in FIG. 2 as drill string 38 is moving upward through the wiper 34, it is naturally putting force on the wiper 34 in the upward direction which would tend to move the upper face 48 of wiper 34 against the top 50 of apparatus 10, yet wiper 34 would be prevented from moving out of chamber 16. However, in view of the fact that cover portions 18, 20 are securely held in place by pin members 52, 54 on that particular end of the apparatus, there may be a question as to whether or not that end of the apparatus which opens and closes, would be securely held in place as the wiper makes contact with the end portions 51 of the apparatus.

Figure 8:
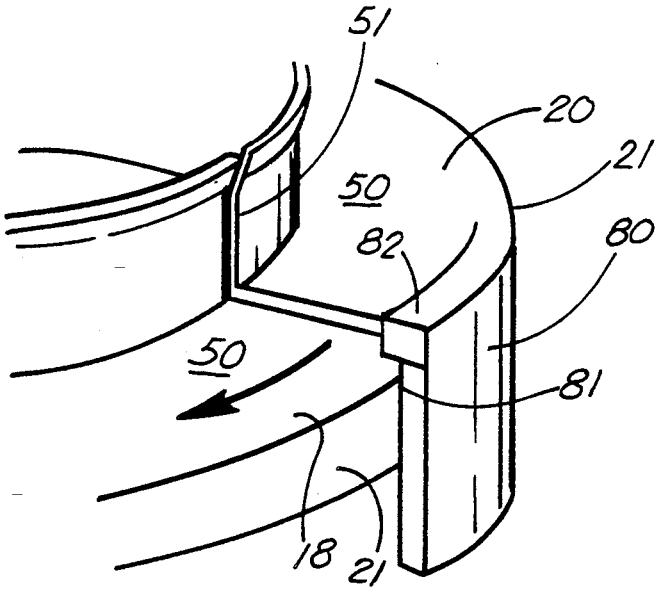
FIG. 8 is an isolated view of the locking mechanism of the preferred embodiment of the apparatus of the present invention.

Therefore, in order to avoid any excess stress on cover 50, reference is made to FIG. 8, where the semi-circular cover portions 18, 20 are substantially in the closed position. There would be included a steel plate 80 secured to the outer surface of housing 12, at the point that the semi-circular cover portions 18, 20 join at 51, which would project upward above the upper surface of the semi-circular cover portions 18, 20. Plate 80 would include a lip member 82 extending inward over the surface 50 of cover members 18, 20, so that when cover members 18, 20 are in the closed position, and force is directed upward by the movement of wiper 34 against closed sections 18, 20, contact is made with lip 82, which prevents the cover from moving upward any further than the contact made with lip member 82. Therefore, the semi-circular cover members 18, 20 are secured in place against the unnecessary stress encountered by the movement of wiper member 34 in the upper position as pipe 38 is being pulled therethrough.

There may be further included a plurality of spray nozzles 100 positioned around the wall of the housing for introducing a pressurized spray of water or other fluid into the housing as the drill string is moved therethrough to assist in cleaning the pipe. The sprayed water would flow into the bell nipple after leaving the housing.

Further, in order to effect easy setting of the apparatus onto the bell nipple 28, there would be included a pair of lifting lugs 88 for easy lifting setting the apparatus in place for use.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus mountable on the upper end of a bell nipple for cleaning and wiping sections of a continuous string of drill pipe being tripped out of a hole, the apparatus comprising:

a) a base portion mountable on the bell nipple;

b) an upper annular housing, further comprising a cover portion, the cover portion including semi-circular cover portions movable between first closed positions surrounding the string of drill pipe, and second opened positions;

c) a rubberized wiper positionable in the housing, the rubberized wiper having a bore for frictionally engaging and wiping the mud off of the wall of the pipe as the pipe moves through the bore in the rubberized wiper;

d) means for automatically moving the semi-circular half portion of the cover from the first closed position to the second opened position; and e) means for maintaining the rubberized wiper in the housing, when the cover is in the first closed position, so that mud wiped off of the wall of the pipe by the wiper is returned downhole and not onto the rig floor, and allows the wiper to be removed from the cover when the housing is in the second opened position.

2. The apparatus in claim 1, wherein there is further included means for spraying water under pressure onto the drill pipe as the drill pipe moves through the housing.

3. The apparatus in claim 1, wherein the semi-circular cover portions of the cover are hingedly engaged along a common edge.

4. The apparatus in claim 1, wherein the means for imparting movement of the semicircular cover portions of the cover between the open position and the closed position further comprises hydraulic means.

5. The apparatus in claim 1, wherein the housing further includes spacer means along the interior floor portion of the housing for supporting the wiper means spaced apart from the floor of the housing.

6. An apparatus mountable on a bell nipple, for wiping and washing the wall of a continuous string of drill pipe being tripped out of a hole, the apparatus comprising:

a) an annular housing spaced along the path of the drill string, so that the drill string moves through the housing as the drill string is tripped from the hole;

b) a rubberized wiper positioned within the housing, the wiper including a bore along its central axis, and of a diameter to frictionally engage and wipe mud from the wall of the drill pipe as the drill pipe moves through the bore in the wiper;

c) first and second half portions of the cover hingedly engaged on their first common edge, and movable between a first closed position to a second opened position for allowing removal of the wiper from the housing; and d) means to move the position of the semi-circular half portions of the cover between the first opened position to the second closed positioned during use of the apparatus, so that when the cover is in the second closed positioned mud being wiped from the wall of the drill pipe by the rubberized wiper is returned downhole and is precluded from spilling onto the rig floor.

7. An apparatus for washing and wiping the wall of a continuous string of drill pipe being tripped out of the hole, the apparatus comprising:

a) a base portion mountable on the upper end of a bell nipple and secured thereto;

b) a housing attached to the base portion, the housing further comprising a cover, including a pair of semi-circular half cover portions, the half portions movable from a first opened position to a second closed position;

c) a wiper, of the type comprised of rubberized material, and having a bore therethrough, the bore of sufficient diameter to frictionally engage the wall of the drill pipe as the drill pipe moves through the housing so that when the housing is in the closed position, the wiper is maintained within the housing;

d) means for spacing the wiper off of the floor of the housing for allowing any flow of mud off of the wiper along the floor portion to return into the bell nipple; and e) hydraulic means attached to the semi-circular half portions of the cover, the hydraulic means allowing the movement of the cover from the opened position to the closed position, wherein in the closed position the wiper is maintained in the housing to clean the drill string being tripped out of the hole, and in the open position, the wiper is allowed to be removed from the housing to be replaced.

8. The apparatus in claim 7, wherein the hydraulic cylinders are operable from a distance away from the apparatus mounted on the bell nipple.

9. The apparatus in claim 7, further comprising means for maintaining the housing in the closed position and to resist the upward movement of the force of the wiper as the pipe is being tripped through the bore and the wiper.

10. The apparatus in claim 7, further comprising means for introducing a pressurized spray of water into the housing as the drill string is moved therethrough.

* * * * *